US006611244B1

(12) United States Patent
Guritz

(10) Patent No.: US 6,611,244 B1
(45) Date of Patent: Aug. 26, 2003

(54) ILLUMINATED, DECORATIVE LED-DISPLAY WEARABLE SAFETY DEVICE WITH DIFFERENT MODES OF MOTION AND COLOR

(76) Inventor: Steven P. W. Guritz, P.O. Box 10022, Portland, OR (US) 97120

( * ) Notice: Subject to any disclaimer, the term of this patent is extended or adjusted under 35 U.S.C. 154(b) by 23 days.

(21) Appl. No.: 09/699,178

(22) Filed: Oct. 30, 2000

(51) Int. Cl.[7] ..... G09G 3/14; F21V 21/08
(52) U.S. Cl. ..... 345/46; 362/103
(58) Field of Search ..... 345/33, 34, 39, 345/44, 46, 82, 83; 362/103, 104, 105, 106, 108, 251, 252, 800, 806; 40/586

(56) References Cited

U.S. PATENT DOCUMENTS

| | | | | | |
|---|---|---|---|---|---|
| 3,521,049 | A | | 7/1970 | Young | |
| 3,689,758 | A | | 9/1972 | Power | |
| 3,737,647 | A | | 6/1973 | Gomi | |
| 3,986,144 | A | | 10/1976 | Russo | |
| 4,096,552 | A | | 6/1978 | Ben-Porat | |
| 4,264,845 | A | | 4/1981 | Bednarz | |
| 4,686,425 | A | | 8/1987 | Havel | |
| 4,709,307 | A | * | 11/1987 | Branom | 362/103 |
| 4,777,408 | A | | 10/1988 | DeLuca | |
| 4,903,176 | A | | 2/1990 | Chen | |
| 4,912,608 | A | | 3/1990 | Lee | |
| 4,973,835 | A | | 11/1990 | Kurosu et al. | |
| 4,975,809 | A | | 12/1990 | Ku | |
| 5,008,595 | A | | 4/1991 | Kazar | |
| 5,113,325 | A | * | 5/1992 | Eisenbraun | 362/103 |
| 5,128,843 | A | | 7/1992 | Guritz | |
| 5,375,044 | A | | 12/1994 | Guritz | |
| 5,424,922 | A | * | 6/1995 | Wise | 362/103 |
| 5,477,433 | A | | 12/1995 | Ohlund | |
| 5,575,554 | A | | 11/1996 | Guritz | |
| 5,690,411 | A | * | 11/1997 | Jackman | 362/103 |
| 5,912,653 | A | * | 6/1999 | Fitch | 362/103 |
| 6,016,038 | A | * | 1/2000 | Mueller et al. | 315/291 |
| 6,097,360 | A | * | 8/2000 | Holloman | 345/84 |
| 6,108,197 | A | * | 8/2000 | Janik | 361/683 |
| 6,362,801 | B1 | * | 3/2002 | Yuhara | 345/83 |
| 6,511,198 | B1 | * | 1/2003 | Erickson | 362/84 |

OTHER PUBLICATIONS

"High Power Full Color Chip Type LED", by Nichia Chemical Industries, Ltd., product literature.

RGB Hex Triplet Color Chart, by Douglas R. Jacobson, 1995.

* cited by examiner

*Primary Examiner*—Steven Saras
*Assistant Examiner*—Paul Bell
(74) *Attorney, Agent, or Firm*—Milton S. Gerstein

(57) ABSTRACT

A relatively small, illuminated, wearable-safety device or item that may also serve as an item of jewelry or ornamental apparel attachment item of jewelry or ornamental apparel attachment which incorporates a series of LED's packages, with each LED package being made of three individual LED's, one of blue, one of green, and one of red, whereby a continuous range of colors may be emitted by selected energizing of each individual LED of an LED package. The LED packages are capable of being flashed in various modes of operation, such as sequential, random, continuous, and the like. The LED packages are also controlled where the colors emitted by each LED package may also have various modes of operation, such as sequential, random, continuous, and the like, where the color emitted by each LED package may be altered according to a fixed or random pattern, all of which are controlled by one microprocessor.

5 Claims, 5 Drawing Sheets

CIRCUIT FOR 7 MULTICOLOR LEDS

ILLUMINATED, DECORATIVE LED-DISPLAY WEARABLE SAFETY DEVICE WITH DIFFERENT MODES OF MOTION AND COLOR

BACKGROUND OF THE INVENTION

The present invention is directed to an illuminated, wearable-safety device for being worn on-the-person such as on clothing, the wrist, neck, and the like, which illuminated, wearable-safety device may also serve or be worn as a bracelet, necklace, rings, apparel pin, broach, earrings, tag, or other relatively small decorative jewelry item, in which a series of multi-colored LED's are controlled to have both multiple modes of motion, such as random, sequential, etc., and multiple modes of color changes, such as random, sequential, etc., where the sequence of colors display of each LED may be altered to provide various color displays, effects and imaging.

In applicant's previous U.S. Pat. No. 5,128,843, which is incorporated by reference herein, there is disclosed an optical wearable-safety device using flexible circuitry that mounts an LED display. The LED display is controlled by a microprocessor that controls the sequencing of the energizing of each individual LED, such that various flashing modes of operation are possible, such as: random, continuous, and sequential.

In each of Applicant's previous U.S. Pat. Nos. 5,375,044 and 5,575,554, each of which is also incorporated by reference herein, there is disclosed an optical device for use on items of jewelry using flexible circuitry that mounts a lamp or LED display. The LED display is controlled by a microprocessor that controls the sequencing of the energizing of each individual LED, such that various flashing modes of operation are possible, such as: random, continuous, and sequential, as well as having a removable translucent cover for each LED. The covers are provided in different colors in order that each LED may have its color changed. However, to change the color of each LED requires considerable effort and time for the user or wearer of the display device, since each translucent cover must be manually and individually changed.

LED displays are known that provide three individual LED's in one LED package. Each LED package consists of an individual green, blue, and red LED, whereby changing the intensity of each individual LED, one may generate different colors. Such an LED-package is manufactured by Nichia Chemical Industries, Ltd. Model No. NSCM310A.

U.S. Pat. No. 4,686,425—Havel, and U.S. Pat. No. 5,008,595—Kazar, disclose such LED packages, where each LED package consists of individual LED's whose intensity are altered to provide different emitted colors. These LED packages are shown in use as part of an illuminated, ornamental display for use in large lighting displays, such as holiday decorations.

SUMMARY OF THE INVENTION

It is the primary object of the present invention to provide a relatively small, illuminated, wearable-safety device or item that may also serve as an item of jewelry or ornamental apparel attachment which incorporates a series of LED's packages, with each LED package being made of three individual LED's, one of blue, one of green, and one of red, whereby a continuous range of colors may be emitted by selected energizing of each individual LED of an LED package, whereby the use of translucent, colored covers for each LED is obviated.

It is another primary object of the present invention to provide such a relatively small, illuminated, wearable-safety device or item that may also serve as an item of jewelry or ornamental apparel attachment which incorporates a series of LED's packages, with each LED package being made of three individual LED's, one of blue, one of green, and one of red, whereby a continuous range of colors may be emitted by selected energizing of each individual LED of an LED package, whereby, not only are the LED packages capable of being flashed in various modes of operation, such as sequential, random, continuous, and the like, but also where the colors emitted by each LED package may also have various modes of operation, such as sequential, random, continuous, and the like, where the color emitted by each LED package may be altered according to a fixed or random pattern, all of which are controlled by one microprocessor.

BRIEF DESCRIPTION OF THE DRAWING

Reference is had to the accompanying drawings, wherein.

DETAILED DESCRIPTION OF THE INVENTION

Figure 1:
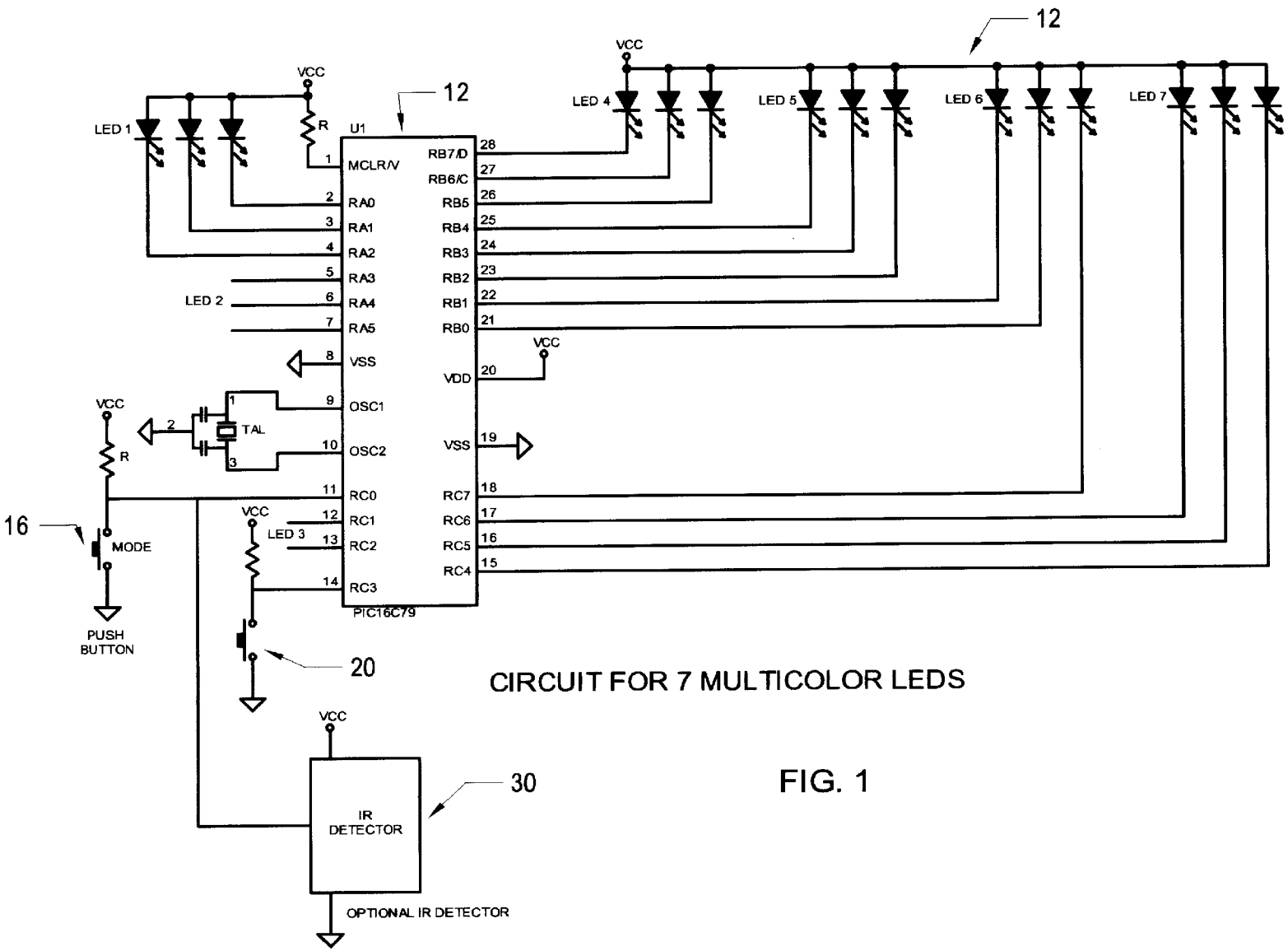
FIG. 1 is a schematic showing the illuminated color display of the invention with LED packages each consisting of three individual LED's being controlled by a microprocessor.

Referring now to the drawings in greater detail, in FIG. 1 there is shown a schematic of the multiple flashing-mode/color-mode, illuminated display 10 of the relatively small, illuminated, wearable-safety device or item that may also serve as an item of jewelry or ornamental apparel attachments for items of jewelry, and the like, of the invention. The display 10 consists of a plurality of LED packages, such as, for example, seven, labeled LED1 through LED7. Each LED package consists of three, individual LED's, one of red, one of green, and one of blue. The LED packages may be those manufactured by Nichia Chemical Industries, Ltd. Model No. NSCM310A. Each LED package is controlled by a microprocessor 12, such as, for example, a 28 pin PIC 16C63 or a PIC16C73 type to drive the 21 necessary lines for the seven tricolor LED's. Each LED package is connected to a respective pin-output. A first push-button 16 is connected to a pin-input of microprocessor 12 which push-button is used for controlling the flashing mode of the plurality of LED packages. The modes possible include those described in applicant U.S. Pat. Nos. 5,375,044 and 5,575,554, which are also incorporated by reference herein. The manner by which these flashing modes are controlled are shown and described in these previous patents to applicant. The device 10 has an additional push-button 20 used for controlling the emitted color of each LED package. The various color modes are described hereinbelow.

Figure 2:
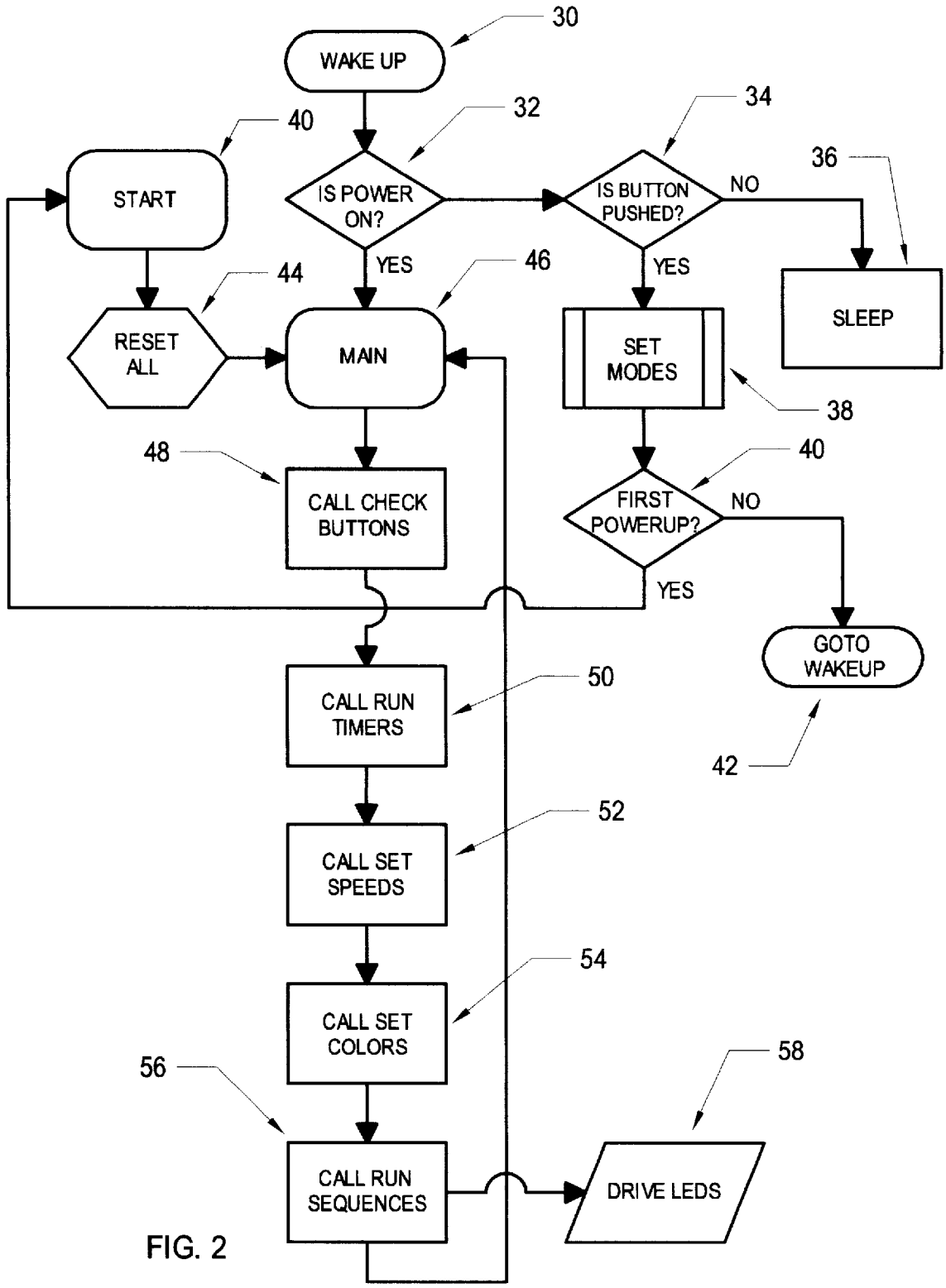
FIGS. 2–5 show flow charts for controlling the microprocessor of FIG. 1 for operating the illuminated color display of the invention such that the emitted color of each LED package may altered for use in various modes of operation.

Referring now to FIGS. 2–5, flow charts are shown describing the software that control the microprocessor 12 for generating various flashing/color modes of operation of the LED display of the device 10 of the invention. In FIG. 2, there is shown power up or wake up (block 30). The program first determines if power is on (decision block 32). If the answer is "NO", then the program determines if the flash-control button 16 has been pressed (decision block 34). If it has not been pressed, then the unit remains dormant (block 36). If it has been pressed, then the program will set a flag of the microprocessor for the particular modes (block 38). This is followed by the decision block "Power Up" (block 40), which determines if it is the first power up or not. If it is not, then the unit simply wakes up (block 42). If it is the first power up, then the unit goes to "START" (block 44) and then presets all flags (block 44). Thereafter, the main program will be initiated (block 46). If the answer to decision block 32 is "YES", meaning the button 16 had been previously pressed, then the program goes directly to "MAIN" (block 46). The main program then calls up the subroutine "CALL CHECK BUTTONS" (block 48), described below with reference to FIG. 3. After calling it up, the programs "CALL RUN TIMERS" (block 50), "CALL SET SPEEDS" (block 52), "CALL SET COLORS" (block 54), and "CALL RUN SEQUENCES" (block 56) are called in order to run the LED packages (block 58) in accordance with the run or flashing mode chosen and in accordance with the color mode chosen. The flash-control button 16, if pushed once and held, will control the power of the device. If it is pushed a second time before a preset timer has expired, then such will cause the previously selected flash-mode to be sped up. If it is pushed a third time before a preset timer has expired, then such will cause the previously selected flash-mode to be slowed down. If pushed a fourth time before a preset timer has expired, then such will cause a mode change from one flashing mode of the LED packages to a different flashing mode. Every time the button is pushed four times, with each pressing occurring before time out, the next flashing mode will be selected.

Figure 3:
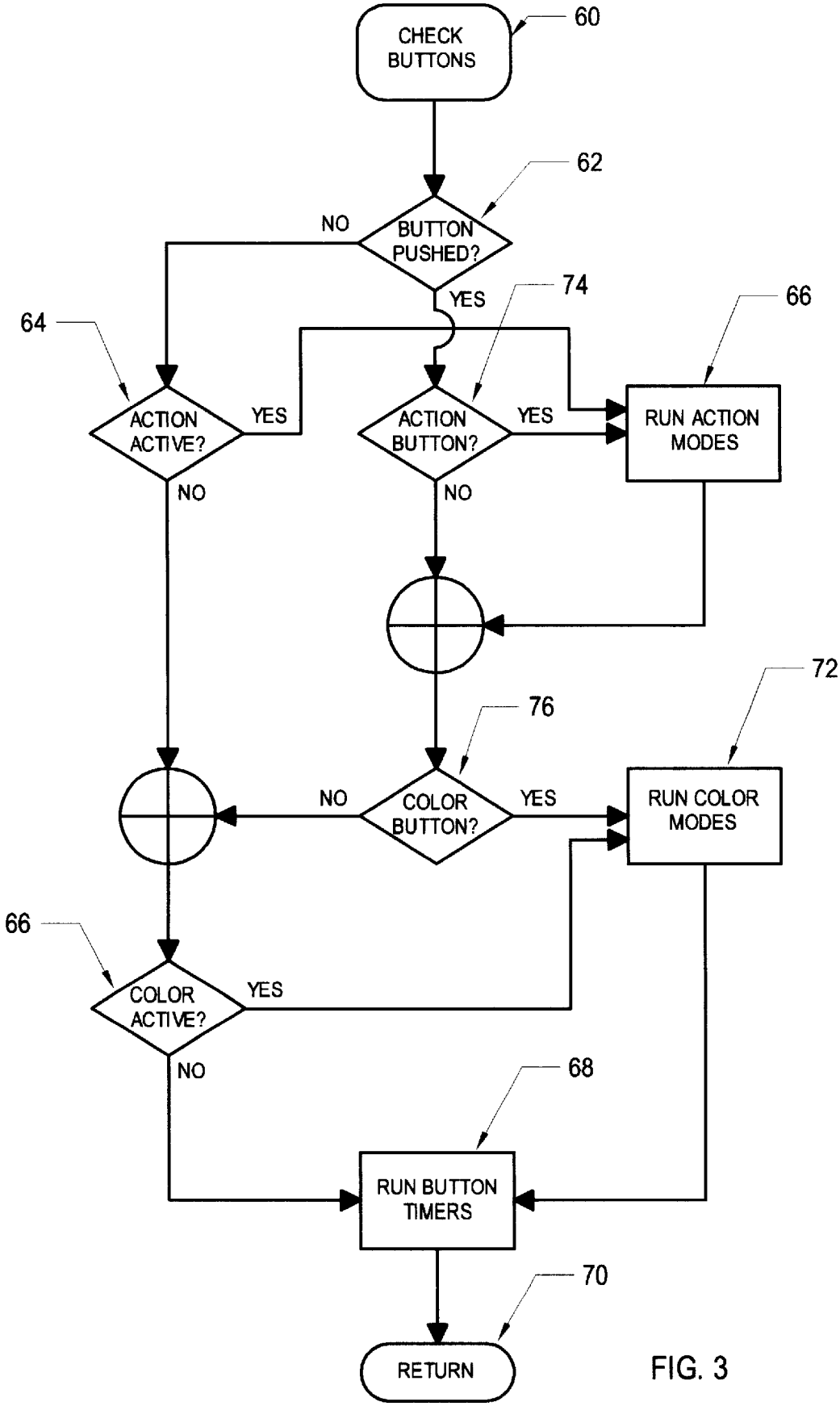

Referring now to FIG. 3, the "CHECK BUTTONS" routine (block 60) is shown. This program checks for the activation of either or both of the flashing mode button 16 and the color mode button 20. The program first decides if a button has been pushed or actuated (decision block 62) within a preset time. If the answer is "NO" for the flashing-mode push-button 16, then the program determines if the color-mode push-button 20 has been pressed within the preset time (decision block 66). If the answer to that is also "NO", then the program runs the timers for the buttons (block 68), at the end of which the program returns (block 70) to block 62. If the answer to decision block 64 is "YES", which means that the button has been pushed four times to set a mode (see below regarding FIG. 4), then that mode associated with the pushing of the flashing mode button 16 will be run (block 66). Similarly, if the answer to decision block 66 is "YES", then the program will set the color mode (block 72) to that associated with the pushing of the button 20. If the answer to decision block 62 is "YES", meaning that a button 16, 18 has been pressed, then the program determines if it was the "ACTION BUTTON" 16 that was pushed (decision block 74). If the answer is "YES", then the action mode associated with that button-pushing will be run (block 66), if the button 16 is not again pushed before the button timer has expired. If the answer to decision block 74 is "NO" or "YES", the program will determine if the color-mode button 20 has been pushed (decision block 76). If "YES", then the color mode is set (block 72) for the mode associated with the particular number of pressings of the button 20, after which the timers are allowed to run out (block 68), assuming that the button has not been again pushed. If the answer to decision block 76 is "NO", then decision block 66 will determine if there a present color mode active, meaning that the color-mode button has been previously pushed, then the color mode for that previous pushing of button 20 will be run (block 72). If the answer to decision block 66 is "NO", then the program will run the button timers, and if it runs out, the color mode will be set to that mode associated with the last pushing of the button 20.

Figure 4:
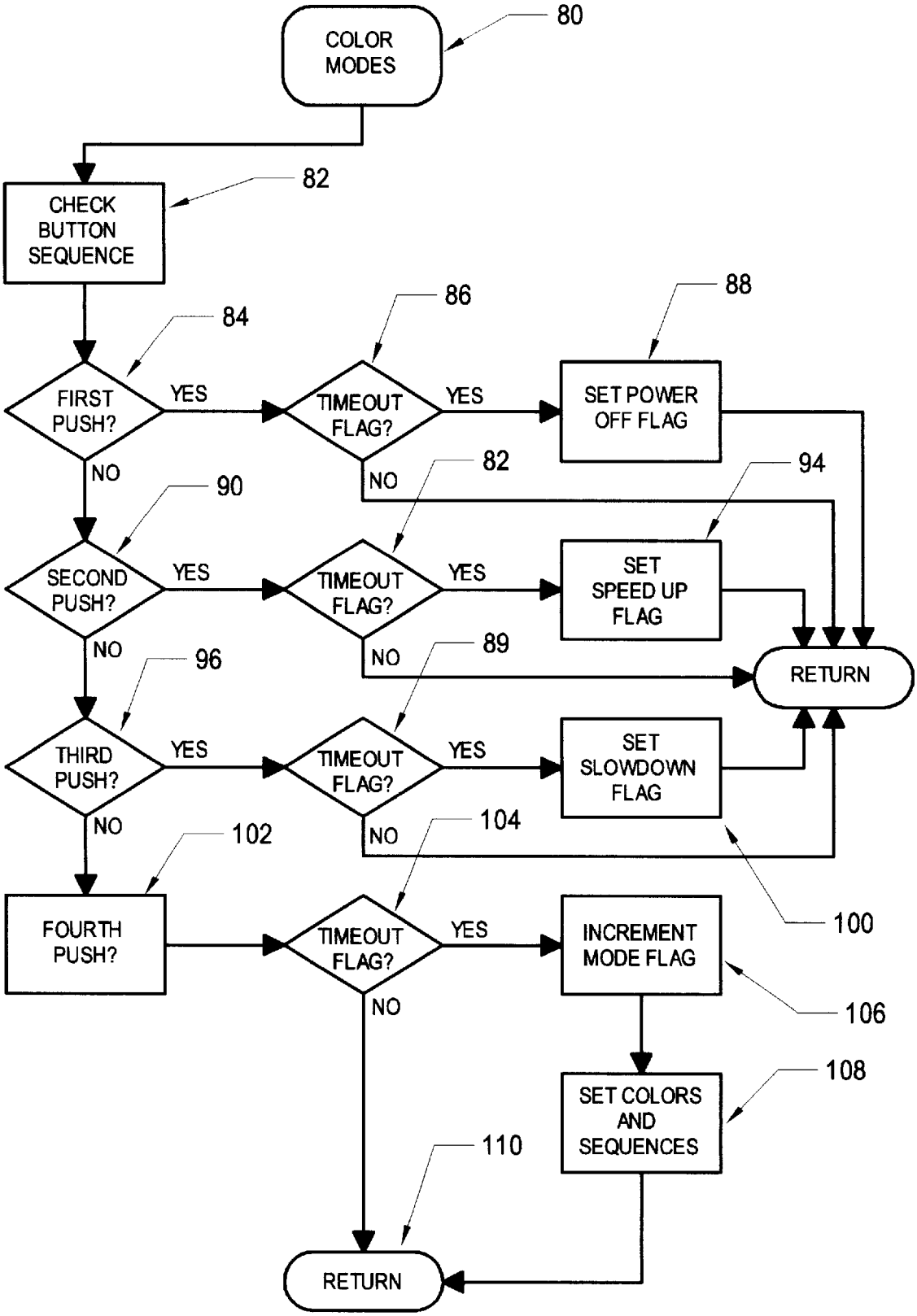

Referring now to FIG. 4, there is shown the color-modes routine (block 80) for setting the color modes by checking the sequence of the pressing of the push-button 20 (block 82). The program first determines if the push-button 20 has been pressed just one time (decision block 84). If the answer is "YES", then if the timeout flag has expired (decision block 86), then the "Power-Off" flag is set in order to turn the power off. If the timer has not yet expired, then the programs returns (block 110). If within the time before the timeout flag of block 86 expires the button 20 is pushed (decision block 90), meaning that the answer to decision block 90 is "YES", then it is determined if the timer has expired (decision block 92), if it has, then the mode "Set Speedup Flag" has been chosen by the user of the device, and the speed of mode chosen (see below) will be sped up (block 94) by setting the flag therefor accordingly to the preset increment. If the answer to decision block 98 is "NO", then the program returns, waiting to see if the button 20 will be pushed again. If the answer to decision block 90 is "NO", meaning that before the timer of block 98 has expired, the button 20 has been pushed again, the program determines if this pushing of the button 20 is the third one via decision block 98, which checks to see if the timer has expired. If it has ("YES" to decision block 98), then the "Set Slowdown" flag will be set (block 100), and the mode chosen (see below) will be run slower. If the answer to decision block 98 is "NO", then the program returns and waits to see if the button 20 is depressed again within the timeout of the timer. If the button is depressed again before timeout, then the answer to decision block 96 is "NO", meaning that the button 20 has been depressed for the fourth time (block 102). This constitutes the "Mode" phase. If the button 20 has not been pressed again before the timer runs out (decision block 104), which means the answer to decision block 104 is "YES", then the "Mode" flag is incremented, such as from continuous to random or from random to sequential, and the like. Then, the program will set the colors and sequences associated with that color mode (block 108). If during the running of the particular mode chosen the button 20 is depressed, then the routine of FIG. 4 is repeated. Thus, if the button is pushed just once, the unit will shut down. If it is pushed twice before timeout, then the chosen color mode will be sped up. If depressed three times before timeout, then the chosen color mode will be slowed down. If depressed four times before timeout, then the color mode itself will be changed, such as from random to sequential, or the like.

Figure 5:
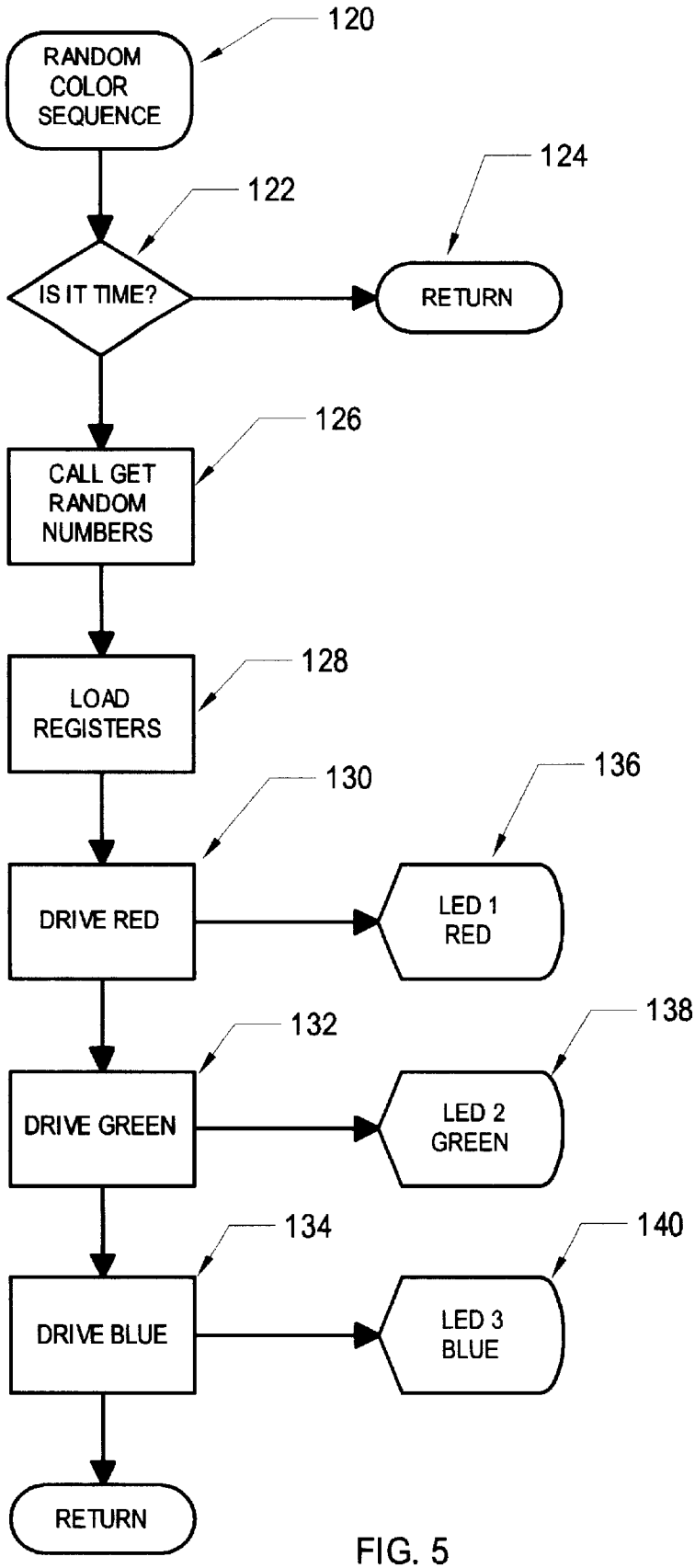

Referring now to FIG. 5, there is shown, by way of example, the "Random Color Sequence" mode routine (block 120), which is but one of the many color modes of the device 10 of the invention, it being understood that the other color modes are similar. The routine first determines if the time has come to change the sequence in accordance with the randomness of the color sequencing of this mode (decision block 122). If it is not yet time to change the pattern, then the program waits (block 124). If the time has come to reset or change the color display and sequencing, then the routine will get the random numbers necessary via a conventional random-number generator (block 126). Thereafter, the program loads the registers of the microprocessor 12 (block 128), and then drives the colors red, green, and blue (blocks 130, 132, 134) in order to generate those colors in the three LED's of each LED package LED1 through LED7 (blocks 136, 138, 140, respectively). Each LED of each LED package is actuated or powered only to that amount necessary in order to display the chosen overall color of the respective LED package associated with the color mode selected, and will drive them for an amount of time also associated with that chosen color-mode and as well in accordance with the flashing mode so chosen.

The flashing modes may be one of the following, it being understood that other modes are possible: Sequential, random, all flashing, inchworm (which is a series of three lights that "inch along" the row of lights), zig-zag (which is the classical "Knight Rider" mode where the light dot runs back and forth from end to end of the band), "rubber band" (where the lights move out from the center then snap back, which is also called "split sequential"), and automatic switching from one of the above to another or others of the above. Regarding the color modes possible, one or more of the following is used: automatic random switching of colors, such as, for example, switching among nine colors; automatic sequencing of colors; rainbow of colors only; and automatic switching among the above-listed modes. Holding the first press of the color button may also allow the selection of one color to be displayed by all LED packages, with a subsequent push and hold returning the color mode to automatic sequencing of nine colors, or the like.

Additional color modes that may be used are: "Fireworks" which starts in the center with white and rapidly moves outwardly as the colors change through yellow to orange to red, "shooting star", where it would start at one end brightly and fade as it runs along the lights, in slightly different colors each time; and "rainbow". The obvious sequencing of all modes with each running for a short period of time is available in any version that has multiple modes.

The internal firmware for the flow charts of FIGS. 2–5 controls the microprocessor 12 by producing very narrow, very fast pulses that are used to vary the intensity of the individual colors within the LED package. This variation can be accomplished by using a few or a bunch of these narrow pulses to vary the individual intensities, with more pulses per unit of time causing brighter light emissions. The sequencing of these pulses to different LED's allows for the combination of moving or flashing modes and changing color-modes to occur simultaneously. This pulsing also reduces the external component count to a minimum, reducing the manufacturing costs accordingly.

An advanced variation of the device 10 may use an external, remote-control device to program in complex arrangements of unique colors and movements. The addition of an infra-ret detector 30 (FIG. 1) is hidden within the device, and the additional firmware are the additions required to use this external programmer.

According to the present invention, since LED packages are used consisting of three separate red, green and blue LED's that are each theoretically infinitely adjustable for color by means of microprocessor 12 and the firmware embedded therein, the number of different combinations are also theoretically infinite, in contrast to prior-art, holiday lighting displays, discussed above. The digital approach of the present invention is to turn on each LED some percentage of each time slot, then off for the remainder of that time slot (0 to 255, or in other words 0 to 100%). The number 255 comes from the fact that system of the device 10 is an "8 bit" system. That is, 8 bits binary, or 2 to the eight power equals 256 separate states (0 to 255), or every combination of the eight binary bits '00000000' to '11111111'. By driving the three LED's in each LED package with different combinations of "on times" listed in a conventional color chart, one is ultimately able to present n256 times 256 times 256 colors. In a practical sense, much fewer combinations would be used because the human eye would have difficulty deciphering the differences.

The lighting device of the invention may be programmed for different markets with different variations of movement and color, with low cost units using selected single color lights and the more expensive units adding more and more color variations. Some would only use color variations, like a necklace that can simulate any of the popular gem stones by back-lighting cut glass with the classic colors (off green for Emerald, white for Diamond, Deep red for Ruby, etc.,) again easily selected in steady or sequenced versions, where, for example, throughout the evening the colors would gradually change from one popular stone to another.

For kids and others it is possible to be able to change from fantasy colors to a flashing red for safety when out at night while walking or at fairs, etc. This works well for cloths, jewelry, or dog collars.

In some organizations, like sponsors of some events, it is useful to be able to identify individuals with different tasks. For example, flashing blue for information, red for first aid, yellow for programs, etc. This works well for hats, jackets, and wrist-wear or neckwear. Mood jewelry would allow the choice of colors for moods, even for "I'm not in the mood."

Other features that may be added to the lighting display for jewelry, clothing, tags, and the like, of the present invention are:

A. Voice command to turn on/off or switch modes and speed changing;

B. Voice repeat—repeats back each voice command;

C. Dimmer switch either by voice command, or touch switch or by preprogrammed automatic dimming or brightening the lights;

D. Programmed chip that would operate ("all colors LED") going from red orange, yellow, green, blue, purple, aqua, pink, which would allow the user to have any color or color combination desired;

E. At any given time, color changes may be made by auto switching, manual or voice command switching;

F. Flexible circuit boards allowing for multiple amounts of LED's to operate 50–100 in rows next to each other—rather than just one line of lights, there might be 5, 10 or more lines of lights next to each other making wider versions of products allowing for programmed messages to come across the lit up LED's. All of the above would have especial use for the lighting display of the invention in rings, necklaces, bracelets, dog/cat collars, jacket or coat lighting systems etc;

G. Light-up, wearable sports and religious items, such as U.S.A. patches, crosses, Jewish stars, etc.

The color modes of the device of the invention may also be include one or more of the following:

A dimmer switch;

an auto-switching mode from light colors to dark colors, or from one dark color to a light color auto-switching which may be stopped with a hold button for picking a certain desired color to remain stationary;

alternating color modes, where one may pick two colors of choice for alternating between them—for example, all seven LED's could be one color at the same time, all alternating from one color to another, or every other LED could be an alternating chosen color;

fantasia mode where mixtures of colors, from light to dark, are displayed in no steady pattern and starting at a different random LED each cycle;

swirling mode where the outer LED's, LED1 and LED7, are illuminated first with colors and working their way to the center LED, and repeating the cycle;

bursting mode where the each color of an LED is faded and rapidly brightened, repeating it—random bursting may be used, or all may be burst at the same time;

chasing mode where different color-choices may be picked to "chase" each other down a row of LED's;

gems mode where a one or two or three LED display such as for a necklace where a clear glass or plastic diamond or ruby cut gem-shape has all color LED's led behind it slowly or quickly auto-changing of a real gemstone color;

double and triple random modes, where the color is sent out two or three times in a cycle before switching to the next color;

double or triple sequenced mode where colors are sent out and repeated two or three times in each cycle;

quivering mode where just the right pulsing is sent out to the LED's that would make the colors appear to quiver or shake.

Instead of a row or rows of LED's, the LED's could be arranged in the form of a picture or letters, and the like. There could be multiple rows and columns of LED's, where warning messages, warning signs, warning pictures, and the like could be displayed. For example, semblance of a fireworks display could be illuminated on a wristband made in accordance with the present invention.

While a specific embodiment of the invention has been shown and described, it is to be understood that numerous changes and modifications may be made therein without departing from the scope and spirit of the invention as set forth in the appended claims.

What I claim is:

1. An illuminated item to be worn on a person or clothing comprising a main body portion configured as one of the following: a small, illuminated, wearable-safety device, item of jewelry, or ornamental apparel attachment; and an illuminated lighting display means mounted on said main body portion, said lighting display comprising:

a plurality of LED-packages, each said LED package comprising three, separate LED's, one green LED, one red LED, and one blue LED;

a microcontroller for controlling the actuation and time span of actuation of each of said three, separate LED's of each said LED package;

said microcontroller comprising memory means;

said memory means having software means stored therein, said software means comprising a first means for causing said microcontroller to produce control signals for each of said three, separate LED's of each said LED package, in order to generate a selected color to be visible from each said LED package;

said software means comprising second means for controlling said first means to display a desired mode of color display of said LED packages, said second means controlling said first means to change the color to be displayed by each said LED package, whereby a plurality of color modes may be generated whereby each LED package will have its displayed color changed after a predetermined, pre-selected duration of time according to a specified color pattern;

said software means comprising third means controlling said LED packages to vary the actuation and illumination thereof to vary the mode of said LED packages from one pattern of apparent movement to another pattern of apparent movement;

control means for controlling the state of said microcontroller, said control means comprising a first actuation means for powering up said microcontroller, and a second actuation means for controlling said second means of said software means;

said second actuation means controlling said second means of said software means to change a selected color mode to a different color mode.

2. The illuminated item according to claim 1, wherein said second means produces at least one of the following color modes for said plurality of LED packages: random switching of color of said plurality of LED packages; sequencing of colors of said plurality of LED packages; and the changing of colors where each said LED package generates a color different from another said LED package.

3. The illuminated item according to claim 2, wherein said second means controls the duration of each color display of each said LED packages for a preset duration of time, said preset duration of time being alterable based on the color mode selected.

4. The illuminated item according to claim 1, wherein said second actuation means controls said second means of said software means to change the speed of a selected color mode.

5. A lighting display comprising a main body portion configured as one of the following: a small, illuminated, wearable device, item of jewelry, ornamental apparel attachment, clothes-worn display, or animal-worn display; said main body comprising:

a plurality of LED-packages;

each said LED package comprising three, separate LED's, one green LED, one red LED, and one blue LED;

a microcontroller for controlling the actuation and time span of actuation of each of said three separate LED's of each said LED package;

said microcontroller comprising memory means;

said memory means having software means stored therein, said software means comprising a first means for causing said microcontroller to produce control signals for each of said three separate LED's of each said LED package, in order to generate a selected color to be visible from each said LED package;

said software means comprising second means for controlling said first means to display a desired mode of color display of said LED packages, said second means controlling said first means to change the color to be displayed by each said LED package, whereby a plurality of color modes may be generated whereby each LED package will have its displayed color changed after a predetermined, pre-selected duration of time according to a specified color pattern;

control means for controlling the state of said microcontroller, said control means comprising a first actuation means for powering up said microcontroller, and a second actuation means for controlling said second means of said software means;

said second actuation means controlling said second means of said software means to change the speed of said selected color mode.

* * * * *